US006287440B1

(12) United States Patent
Arnold et al.

(10) Patent No.: US 6,287,440 B1
(45) Date of Patent: Sep. 11, 2001

(54) METHOD FOR ELIMINATING GAS BLOCKING IN ELECTROKINETIC PUMPING SYSTEMS

(75) Inventors: Don W. Arnold; Phillip H. Paul, both of Livermore; Joseph S. Schoeniger, Oakland, all of CA (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/336,535

(22) Filed: Jun. 18, 1999

(51) Int. Cl.[7] ..... B01D 57/02
(52) U.S. Cl. ..... 204/450; 204/601
(58) Field of Search ..... 204/450, 600, 204/647, 648, 601

(56) References Cited

U.S. PATENT DOCUMENTS 5,942,093 * 8/1999 Rakestraw et al. ..... 204/450

FOREIGN PATENT DOCUMENTS

WO 99/16162 4/1999 (WO) .

OTHER PUBLICATIONS

Weigl, B. and Yager, P., "Microfluidic Diffusion–based Separatlon and Detection", *Science*, 283, 346–7, Jan. 15,1999.

* cited by examiner

*Primary Examiner*—Kathryn Gorgos
*Assistant Examiner*—Thomas H Parsons

(57) ABSTRACT

A method for eliminating gas bubble blockage of current flow during operation of an electrokinetic pump. By making use of the ability to modify the surface charge on the porous dielectric medium used in electrokinetic pumps, it becomes possible to place electrodes away from the pressurized region of the electrokinetic pump. While gas is still generated at the electrodes they are situated such that the generated gas can escape into a larger buffer reservoir and not into the high pressure region of the pump where the gas bubbles can interrupt current flow. Various combinations of porous dielectric materials and ionic conductors can be used to create pumps that have desirable electrical, material handling, and flow attributes.

6 Claims, 4 Drawing Sheets

FIG. 1
Prior Art
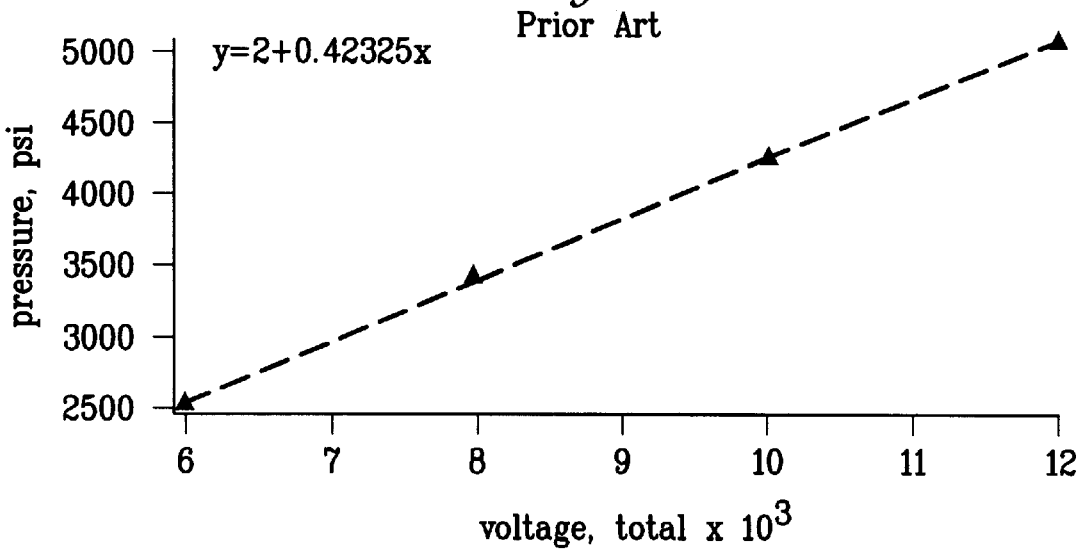
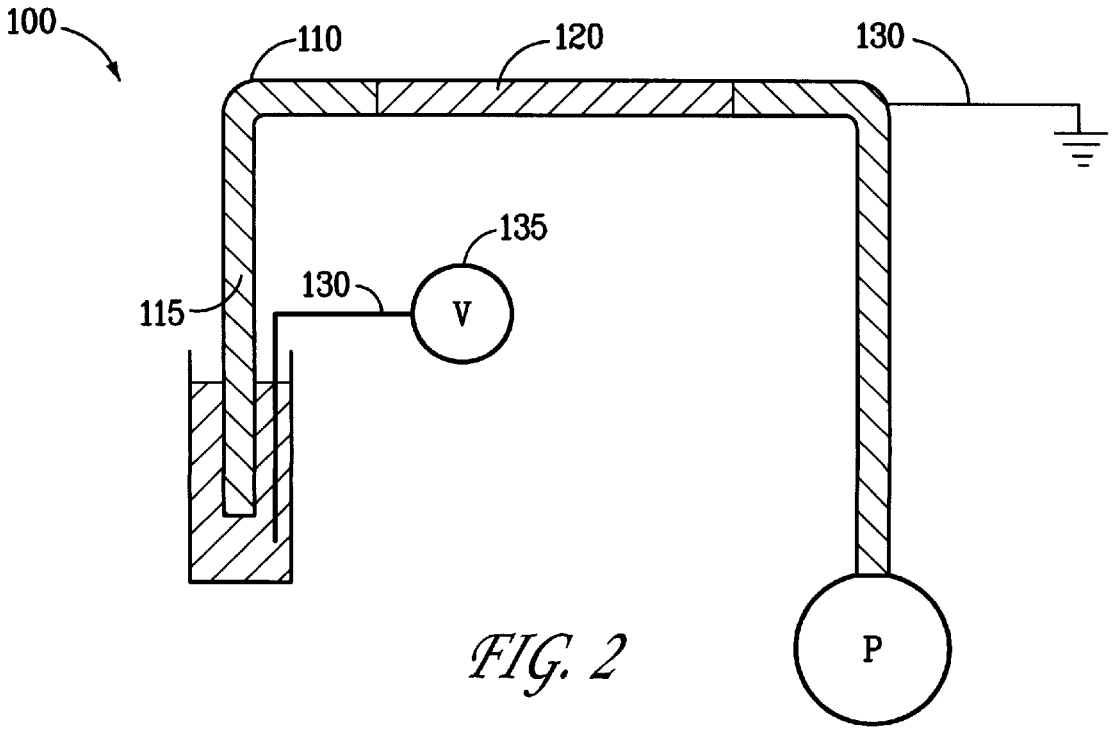
FIG. 2

METHOD FOR ELIMINATING GAS BLOCKING IN ELECTROKINETIC PUMPING SYSTEMS

STATEMENT REGARDING FEDERALLY SPONSORED RESEARCH OR DEVELOPMENT

This invention was made with Government support under contract no. DE - AC04- 94AL85000 awarded by the U.S. Department of Energy to Sandia Corporation. The Government has certain rights in the invention.

CROSS-REFERENCE TO RELATED APPLICATIONS

Not applicable.

BACKGROUND OF THE INVENTION

1. Field of the Invention

This invention pertains generally to a method for improving the performance of electrokinetic pumps that produce high pressures by converting electric potential to hydrodynamic force. More particularly, by manipulating the surface charge or zeta potential of a porous dielectric material used in these electrokinetic pumps, this invention provides a method for eliminating gas bubble induced blocking of current flow, and consequent pump failure, caused by electrolytic decomposition of the electrolyte.

2. Description of the Related Art

It has been demonstrated that it is possible, by means of a process called electrokinetic pumping, to produce hydraulic pressures in excess of 5000 psi by the application of a voltage gradient along a porous dielectric in contact with a conductive electrolyte material using at least two spaced electrodes, as shown in FIG. 1. A detailed discussion of the electrokinetic pumping process can be found in prior co-pending U.S. Pat. No. 6,013,164 and entitled ELECTROKINETIC HIGH PRESSURE HYDRAULIC SYSTEM, assigned to the same assignee. In electrokinetic pumping, an electric potential on the order of hundreds to thousands of volts, well above the potential required for electrolytic decomposition of any electrolyte, is required to develop the desired high pressures. Electrolytic decomposition of the electrolyte results in gas generation and the gas generated at the high pressure side of an electrokinetic pump can form bubbles that can block the current flow required for pressure generation, causing pump failure. This condition is particularly troublesome in miniaturized applications, such as in capillary tubes or microchannels, an area where the use of hydraulic pressure for manipulation of liquids holds great promise, but where current flow can be easily blocked. What is needed is a means for eliminating blocking current flow by bubble formation in electrokinetic pumping applications or providing for any gas generated to be removed from the system before operational complications are created.

SUMMARY OF THE INVENTION

The present invention provides a method and an apparatus for eliminating electrokinetic pump failure caused by gas bubbles formed by electrolytic decomposition of an electrolyte thereby blocking current flow through the electrokinetic pump.

By controlling the surface charge or effective zeta potential of the porous dielectric medium used in electrokinetic pumps it is possible to control the direction of electroosmotic flow and thus the direction in which hydraulic pressure is applied by an electrokinetic pump. When a common junction is formed between the outlets of two or more electrokinetic pumps, having dielectric media that provide different effective zeta potentials, the difference in the direction of electroosmotic flow created when voltages are applied to these pumps generates a hydrostatic pressure at the common junction that can create pressure-driven flow from this junction. Moreover, since the flow is purely pressure-driven there is no electric field associated with these flows in contrast to conventional electroosmotically driven flows. By taking advantage of this phenomenon, the present invention provides a novel electrokinetic pump configuration that allows placement of electrodes away from the pressurized region of the pump, thereby eliminating blocking of capillary channels by gas bubbles that can interrupt current flow and lead to pump failure. Further, the novel electrokinetic pump configuration described herein provides for other unique applications of electrokinetic pumping, in particular, an apparatus and a method for controlled blending of different fluids and for producing layered or "sheath" flow of fluids.

In one aspect of the present invention, the inventive device employs a porous dielectric pump medium that has a negative surface charge to form one segment of a pump configuration and a second porous dielectric pump medium that has a positive surface charge to form the second segment. By arranging these pump segments in an opposing configuration it is possible to generate very high pressures at the intersection of the pump outlets. Moreover, by placing the electrodes at the low-pressure side of the pump, bubble formation that could lead to current interruption and pump failure is eliminated. In another aspect of the invention disclosed here, one or more of the porous dielectric pump media can support ionic conduction but minimal or no electroosmotic or pressure-driven flow (e.g., a salt bridge). Voltages can be applied in series or parallel, or both, in order to create various combinations of electroosmotic flow, pressure-driven flow, or both.

BRIEF DESCRIPTION OF THE DRAWINGS

These drawings include the following figures, with like numerals indicating like parts:

FIG. 1 shows the relationship between voltage and hydrodynamic force generated by an electrokinetic pump.

FIG. 2 illustrates a conventional electrokinetic pump configuration.

DETAILED DESCRIPTION OF THE INVENTION

Figure 3:
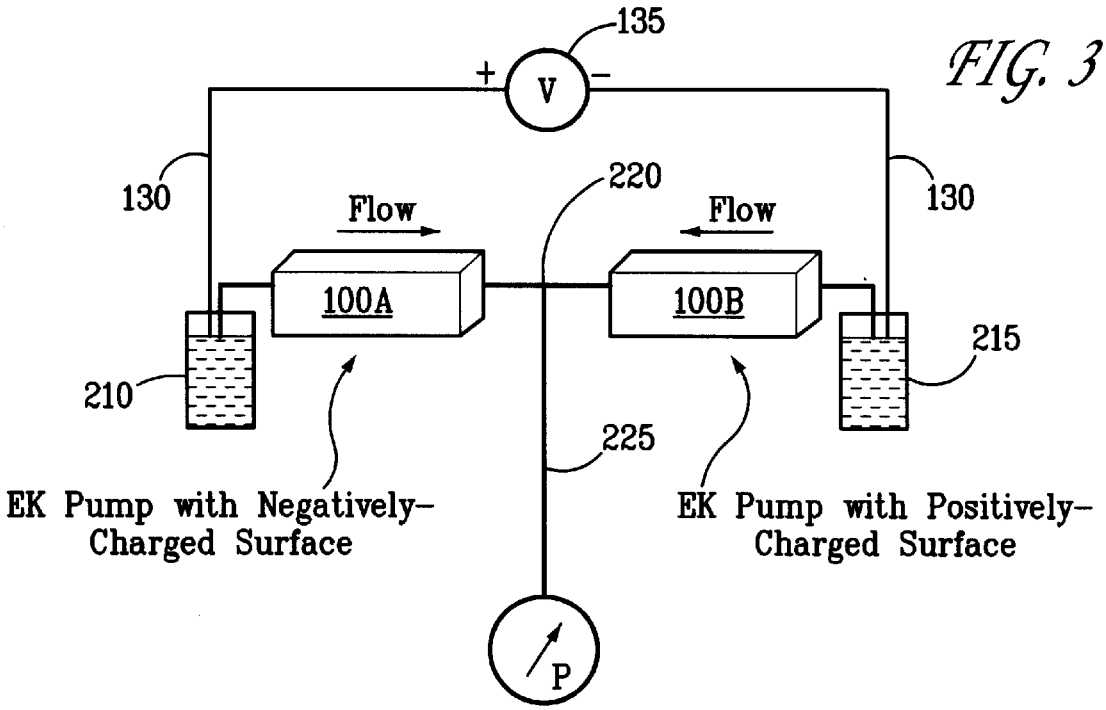
FIG. 3 illustrates an embodiment of the present invention.

The present invention provides a method and apparatus for eliminating the influence of electrolytic gas bubbles formed during the process of electrokinetic pumping that can cause pump failure by blocking current flow. By making use of the ability to modify the surface charge or effective zeta potential on the porous dielectric media used in electrokinetic pumps, the inventive apparatus described here allows the placement of electrodes away from the pressurized region of an electrokinetic pump that can be characterized by channels having very small transverse dimension, such as capillaries or microchannels, and thus easily blocked by a gas bubble. While gas is still generated at the electrodes they are situated such that the generated gas can escape into a larger buffer reservoir without creating operational complications.

In accordance with the present invention, it has been discovered that by taking advantage of a fundamental physical phenomenon, namely by controlling the nature of the surface charge or effective zeta potential on the porous dielectric pumping medium that comprises a part of an electrokinetic pump, it is possible to control both the magnitude and the direction of electroosmotic flow and thus the magnitude of the hydraulic force applied as well as the direction that the hydraulic force is applied. In this way, the electrodes used to generate the voltage gradient that produces the hydraulic pump force can be placed at the low pressure side of the electrokinetic pump, away from the high pressure side where bubble formation can lead to current interruption and pump failure.

In order to understand the present invention better, the following introductory discussion is provided. Referring now to FIG. 2, an electrokinetic pump or EKP 100 generally consists of at least one duct or channel 110, that can be a capillary channel or microchannel, that forms a fluid passageway having an inlet and an outlet. The capillary duct or channel contains an electrolyte 115 and has a porous dielectric medium 120 disposed therein between one or more pair of spaced electrodes 130. Porous dielectric medium 120 can include small particles, high surface area structures fabricated within the microchannel, or microporous materials. An electric potential 135 is applied between electrodes 130 in contact with electrolyte 115, that can be an aqueous or an organic liquid or mixtures thereof, to cause the electrolyte to move in the microchannel by electroosmotic flow.

Because an electric double-layer forms at the solid-liquid interface within the porous dielectric medium, application of a voltage gradient across the EKP generates a driving force that will cause the electrolyte contained in the porous dielectric medium to flow and presented with an external flow resistance can create hundreds of atmospheres of pressure at the down stream or outlet end of the EKP (cf. FIG. 1). The flow rate of the electrolyte is proportional to the magnitude of the applied electric field (V/m applied across the EKP) and the pressure generated is proportional to the voltage across the device.

In addition to using the polarity and magnitude of the applied electric potential to control the direction of flow of the electrolyte with respect to the EKP inlet and outlet and thus the direction of application of the hydraulic force, the direction of flow of the electrolyte can also be determined by both the nature of the electrochemical interaction between the electrolyte and the porous dielectric medium. The inventors have found that by controlling the surface charge or zeta potential of the porous dielectric medium it is possible to control the direction of application and magnitude of the hydraulic force generated by an EKP. By way of example, a silica-based porous dielectric medium, including porous glass, has a negative surface charge and thus the electrolyte will flow toward the more negative electrode potential. On the other hand, alumina at neutral pH levels, having a positive surface charge, causes the electrolyte to flow toward the more positive electrode potential. The surface charge on the porous dielectric material can be selected either by choosing materials having the desired surface charge or by chemically modifying existing porous dielectric materials. Chemical synthesis methods can be used to derivitize the surface with permanent charges or pH dependent charges for greater control over the sign of the surface charge. By way of example, standard methods have been developed that provide for derivitization of normally negatively charged silica surfaces with positively charged compounds such as organosilanes with terminal quaternary amine groups attached to silanols that are on the surface of the silica by reaction of chlorosilane or alcoxysilane. Another approach that provides flexibility and control over the surface charge is the use of polymeric or sol-gel monoliths as the porous dielectric medium. In this instance, adjusting the composition of the polymer precursor mixture can control the nature of the surface charge. A controlled density of either positive or negative charges can be incorporated in the polymer structure.

Referring now to FIG. 3, which illustrates one aspect of the present invention, the outlets of two electrokinetic pumps, 100A and 100B, are connected such that the two pumps are placed in opposition to one another and joined at a common intersection. The composition of each EKP is similar to that shown in FIG. 2 except that the porous dielectric medium in each pump has a different surface charge or zeta potential. By way of example, in EKP 100A porous dielectric medium 120 can have a negatively charged surface and in EKP 100B porous dielectric medium 120 can have a positively charged surface. Further, in the present invention, voltage from power source 135 is applied to electrodes 130 placed in the inlet reservoirs 210 and 215 of each EKP rather than on the low and high pressure sides of the porous dielectric medium 120, as would be the case for a conventional electrokinetic pump (cf. FIG. 2). When voltage is applied, electrolyte 115 flows through both EKP 100A and EKP 100B toward intersection 220, where a high hydraulic pressure can be developed, and into flow channel 225, where the developed hydraulic pressure can be applied. As is the case with electrokinetic pumps generally, the magnitude of the pressure generated is dependent upon the voltage applied and the size of the pores of the porous dielectric medium. For that aspect of the present invention illustrated in FIG. 3, the maximum attainable pressure is reached when the sum of the electroosmotic flows toward the intersection is balanced by the sum of the pressure driven flow away from the intersection. It will be appreciated by those skilled in the art that in this EKP embodiment there is no electric field in the channel where the electrolyte flows away from intersection 220. Thus, a sample introduced into flow channel 225, downstream from intersection 220, is subjected only to pressure-driven flow and not to the high electric field common to electroosmotic flow.

In a second aspect of the present invention, the porous dielectric medium of EKP 100B is selected so as to suppress pressure-driven and electroosmotic flow but still support ionic conduction through the fluid. In this case, when voltage is applied electrolyte 115 flows through EKP 100A, which supports electroosmotic flow, toward intersection 220. However, while EKP 100B supports ionic conductivity it resists electroosmotic flow as well as pressure-driven flow and thus a high hydraulic pressure is developed at intersection 220 and electrolyte 210 flows into channel 225. It will be appreciated that the roles of EKP 100A and EKP 100B can be reversed.

Suppression of electroosmotic flow can be caused by selecting a porous material that exhibits a negligible zeta potential, by coating a material to reduce the zeta potential or by a reduction of the pore size to the point where the porous dielectric material can no longer support electroosmotic flow. By reducing the pore diameter to a value of about twice the double layer thickness it is possible to repress electroosmotic flow but maintain ionic conductivity. By way of example, a 2–3 mM sodium chloride solution has a double layer thickness of about 5 nm. Thus, a porous dielectric material having pores of about 10 nm in diameter will prevent, or significantly reduce, electroosmotic as well as pressure-driven flow but ionic conduction will still be maintained.

The inventors have contemplated variations of the configuration illustrated in FIG. 3. The EKP can take a wide variety of shapes, such as, but not limited to, capillaries, tubes, plates and disks; the desirable pump shape depending upon the application. While the aspect of the present invention illustrated in FIG. 3 shows only two pumps, any number of opposing pumps can be used in the manner shown to generate any desired combination of pressure and flow rate. Moreover, the components of the pump configuration can be formed in a wide variety of non-conducting polymeric and ceramic substrates, in a planar format, by a variety of microfabrication techniques, that can include, but are not limited to, wet/dry etching, laser machining, molding, and micromachining (LIGA). It is contemplated that the electric potential applied between spaced electrodes 130 can assume various forms suitable to the operation of the system described herein such as having a varying amplitude, shape, and period.

The general pump configuration generally described above, employing materials that generate electroosmotic flow in opposite directions when exposed to the same polarity of electric field, has an additional advantage when compared to the electrokinetic pump configuration disclosed and claimed in U.S. Pat. No. 6,013,164 entitled ELECTROKINETIC HIGH PRESSURE HYDRAULIC SYSTEM. The rate of gas generation at the electrodes is directly proportional to current flow. For a given pressure or flowrate, it will be appreciated that the configuration of FIG. 3, using two electrokinetic pumps having opposite directions of flow, will require twice the total voltage and one-half the total current compared to an electrokinetic pump configured as in FIG. 2. Consequently, the configuration of FIG. 3 will provide a reduction in gas generation by a factor of about two, which is particularly advantageous when potentially explosive mixtures of hydrogen and oxygen can be produced.

Figure 4:
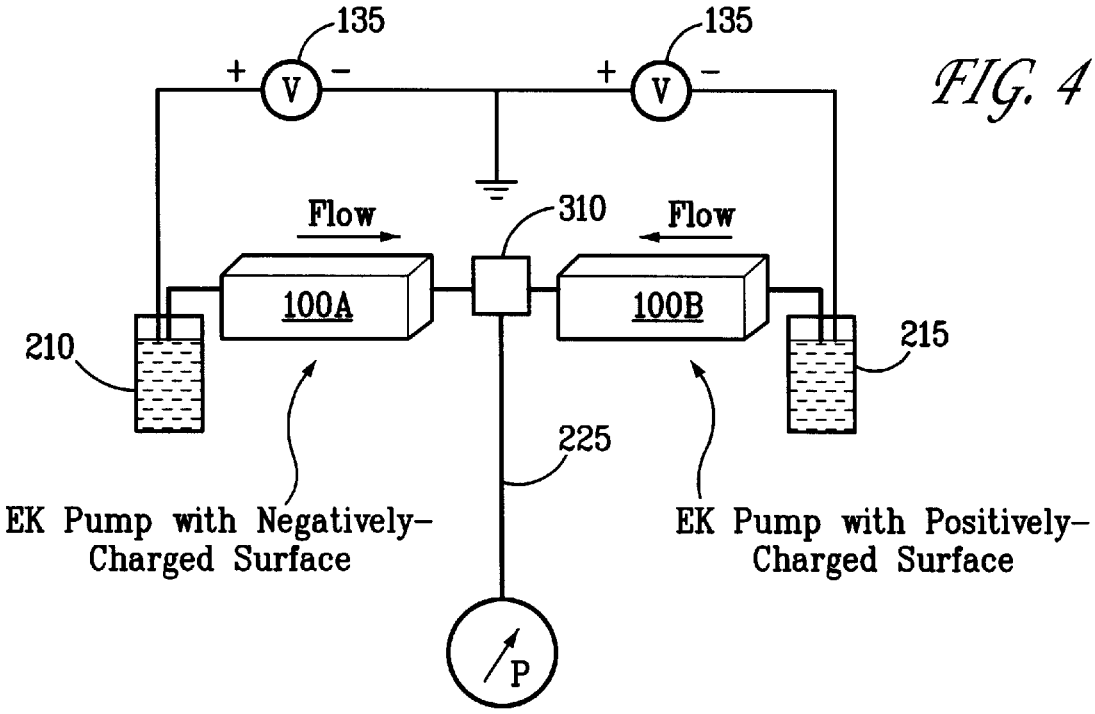
FIG. 4 illustrates a gradient elution embodiment of the present invention.

In addition to relief from current interruption caused by bubbles and other problems associated with electrolytic gas generation, the inventive apparatus disclosed herein is particularly advantageous for processes such as chemical separations or chemical analysis that can require a change in composition of the chemicals used during the course of the process. A technique such as gradient elution is particularly useful when the components of a mixture have a range of properties or the mixture being analyzed is complex and no single mobile phase composition is appropriate for separating them all. In the gradient elution process, the liquid phase composition is gradually modified to achieve a solvent gradient. The creation of the solvent gradient can be accomplished by using two electrokinetic pumps, as illustrated in FIG. 4, with the addition of mixing chamber 310 and means to provide ionic current flow but not electroosmotic flow, such as would be provided by a salt bridge, connected from mixing chamber 310 to power source 135. Electrokinetic pumps 100A and 100B deliver the fluids contained in reservoirs 210 and 215 to mixing chamber 310. Mixing chamber 310 provides a secondary or common fluid whose composition is some combination of the fluids contained in reservoirs 210 and 215. The secondary fluid, whose composition can be controlled and varied by adjusting the voltages provided by power source 135 and thus, the relative output flows from the individual electrokinetic pumps, leaves mixing chamber 310 and flows into flow channel 225. The ratio of the quantities of the two fluids present in the resulting secondary or common fluid can be given by the expression $$Q_A / Q_B = \frac{g_A V_A (k_R + k_B) - g_B V_B k_A}{k_R (g_A V_A - g_B V_B)},$$

wherein, Q is the fluid flow rate, g and k are system constants proportional to the cross-sectional area of the tube or channel through which the fluid flows divided by the length of the tube or channel, V is the voltage applied by the power supply.

The inventive apparatus further provides a solution to the problem encountered when the two fluids being mixed to form the solvent gradient are so different that the same porous dielectric material cannot be used to pump them. By way of example, silica will not generate significant electroosmotic flow below a pH of about 2.2. Consequently, a pump(s) having a silica porous dielectric medium cannot be used to generate a pH gradient by pumping a acidic fluid (pH<2) and another fluid of neutral or basic pH into an intersection. However, by using the configuration illustrated by FIG. 3, a silica-based pump, providing a flow of material having neutral or basic pH, intersecting with a pump having a porous dielectric medium composed of a material that supports electroosmotic flow at low pH can be used for this application.

While FIG. 3 illustrates the use of two pumps meeting at a common intersection, it is a logical extension of the present invention to connect several pumps, whose porous dielectric materials have the same surface charges or zeta potentials, in parallel to a common intersection and that the voltage can be applied with or without an electrical connection at the common junction of these pumps. In this way, it is possible to provide an increased fluid flow through the intersection by increasing the total cross-sectional area of the pump system. The total fluid flow is still related to the current flow through the system. The flow rate can then be increased by varying the number of pumps to which voltage is applied, as well as the magnitude of the applied voltage.

Since the electrolyte used for the EKP is conductive it can be desirable to ground the high-pressure region, e.g., intersection 220, to avoid a short circuit through the liquid to the outside world or to other sections of a microfluidic circuit. In this instance, a bipolar power supply can be used and an electrode attached at intersection 220, by means of a salt bridge, defines the ground plane of the fluid circuit. In principal, if the voltages and electrical resistances of the porous dielectric medium were appropriately chosen, no current at all would flow through the ground electrode. By defining the ground plane with an electrode, the potential applied across each EKP can be varied in a more independent manner to match flow rates and balance pressures generated by each pump. A further advantage to this design is that, while maintaining a desired hydraulic pressure or flow rate, the high-pressure region can be operated at ground potential or, in fact, floated at any desired potential by adjusting the sum and difference of the applied high voltages. Alternatively, a ground-isolated power supply such as 135 connected to electrode 130 can be employed, in which case, an electrode installed at intersection 220 will not draw a current and consequently, will not generate gas but will define the potential of the remaining downstream fluidic circuit.

In an alternate configuration, a potential can be applied across a salt bridge placed at intersection 220 to define a ground plane. In this case, a section of ultra micro-porous material, such as the porous glass sold under the trademark VYCOR, having nominally 4 nm pores, or a membrane such as that sold under the trademark NAFION saturated with electrolyte carries the current but the pores are sufficiently fine that pressure-driven or electroosmotic flow is negligible. Thus, while there is a pressure drop across the salt bridge there is no material flow. In most situations, a ground can be placed at the end of the high pressure connecting line. There will be a small voltage drop along this line that will have negligible impact upon the pumping system.

An additional feature of the pump designs described above is that they can be used to electrokinetically pump two or more flows of identical, similar, or disparate liquids into a common channel or reservoir. Such a common channel or reservoir can be held at ground potential, eliminating electroosmotic flow, and allowing purely pressure-driven flows to be produced in this common space. Alternatively, various mixtures of electroosmotic flow and pressure-driven flows can be produced in a controlled manner. Of particular interest is the ability to arrange the shape, size, and orientation of the fluid outlets from each of the pump segments such that layered flows of different materials can be produced. An example of this latter capability is the creation of so-called "sheath flows".

It is known in the art, that the flow pattern of liquids flowing in channels having either width or height less than about 200 $\mu$m is laminar (cf. Weigl, B. H. and Yager, P. *Microfluidic Diffusion-Based Separation and Detection,* Science, 283, 346–7, 1999). Thus, two or more layers of fluid can flow next to each other without any mixing other than interdiffusion of their components. In such a flow pattern, a layer of another flowing fluid surrounds a central layer or column of a flowing fluid (in one or two dimensions). As a consequence of this flow pattern, material in the central layer does not contact the walls of the constraining medium (which can be the walls of a fluid channel or a stagnant reservoir liquid) except by diffusion. This can have advantages, such as minimizing parabolic flow-induced dispersion of chromatographic bands carried in the central layer, or allowing reduced optical scatter from the walls of a channel when optical methods are employed to detect or determine the properties of materials carried in the central layer.

Figure 5A:
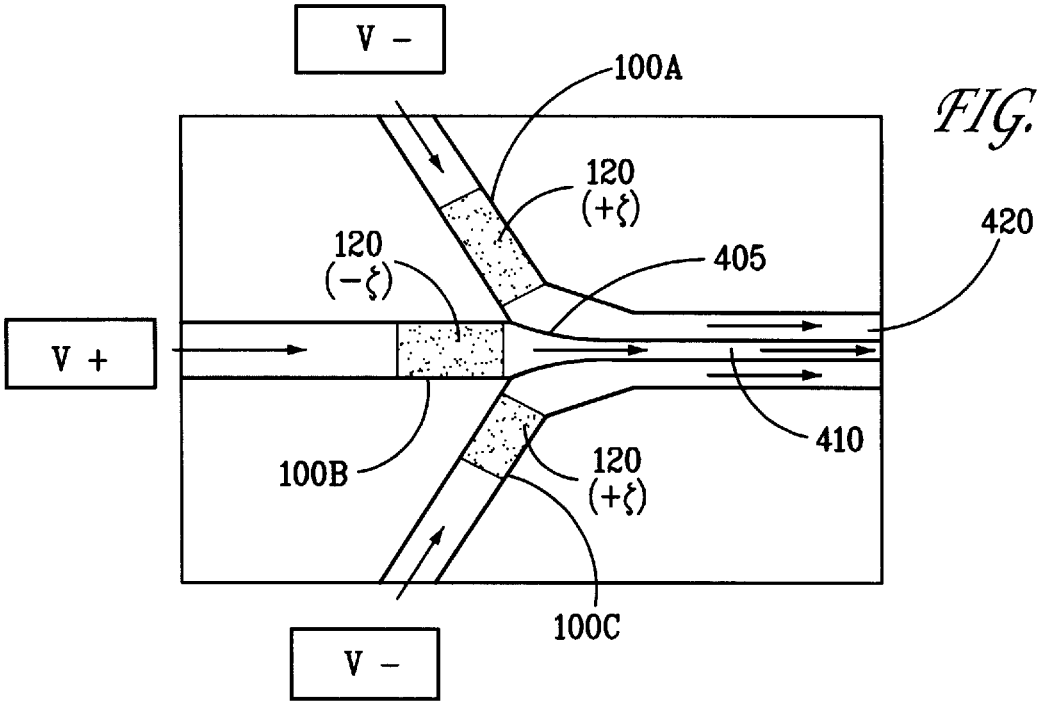
FIGS. 5*a* and *b* shows an apparatus for producing layered fluid flow.

As illustrated in FIG. 5*a,* the electrokinetic pumps of the present invention provide means for producing layered or "sheath flow". Here, the outlets of three electrokinetic pumps 100A, 100B, and 100C converge at a common junction 405. For purposes of illustration, the pumps may be visualized as lying in channels having rectangular cross section, these channels being formed in a solid flat block of material. The fluid 410 flowing in the center of exit channel 225 experiences less shear because it is not in contact with the side walls of the flow channel, where its velocity would be zero. The fluid flowing from the outlets of electrokinetic pumps 100A and 100C can form a fluid sheath 420 that surrounds (in one or two dimensions) fluid 410 and through which center flow travels. In the configuration shown here, flow from the junction can be purely pressure driven. Turbulent mixing of such microflows is inappreciable. The shape and orientation of the apertures from which the fluid flow emerges from each pump can be made such that the surface area of the flow stream emerging from each nozzle is minimal, essentially maintaining a layered flow pattern, as shown. If different solutions flow from pumps 100A and 100C than flow from pump 100B, the materials in the various solution will mix downstream from their point of convergence (405) through diffusion in a controlled manner.

Figure 5B:
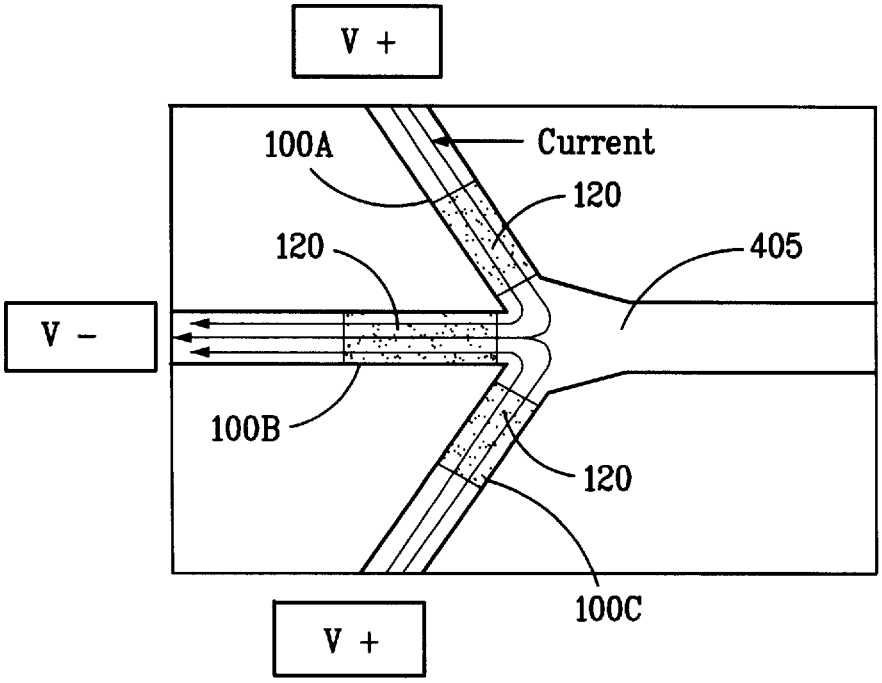

FIG. 5*b* shows the approximate nature of the pattern of the field lines, which is also the current pattern. It is possible for there to be essentially no field lines in the region to the right of junction 405. This will occur, for example, if the electrical resistance of a pump having a porous dielectric material 120 with a positive zeta potential (+ζ) were twice that of a pump having a porous dielectric material 120 with a negative zeta potential (−ζ), then the junction would be at ground potential, and no current would flow through the fluid leaving the common junction if an exit reservoir (not shown) were held at ground potential. Thus, any electrical device, such as an electrode pair, placed sufficiently far downstream from common junction 405 would have no interaction with the high voltage power supplies that power electrokinetic pumps 100. For example, if pump 100B, having a negative zeta potential (−ζ), were a chromatography column or one of the diffusion-based devices cited above, this geometry could be employed in conjunction with a porous working electrode and counter electrode in the exit flow to facilitate electrochemical detection of eluting species. Not only is the working electrode decoupled from the field, but also the high pressure generated at the junction facilitates forcing the eluate through porous electrode materials.

Figure 6:
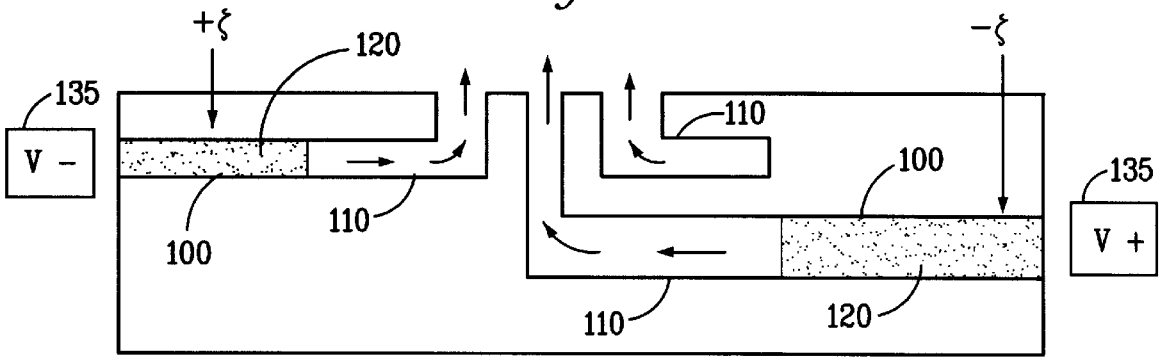
FIG. 6 illustrates microfabricated structures in planar substrates for producing layered flow.

Another embodiment of the apparatus for providing "sheath" flow in microfabricated structures in planar substrates is shown in FIG. 6. Here, the sheath flow would emerge normal to the plane of the substrate.

Figure 7:
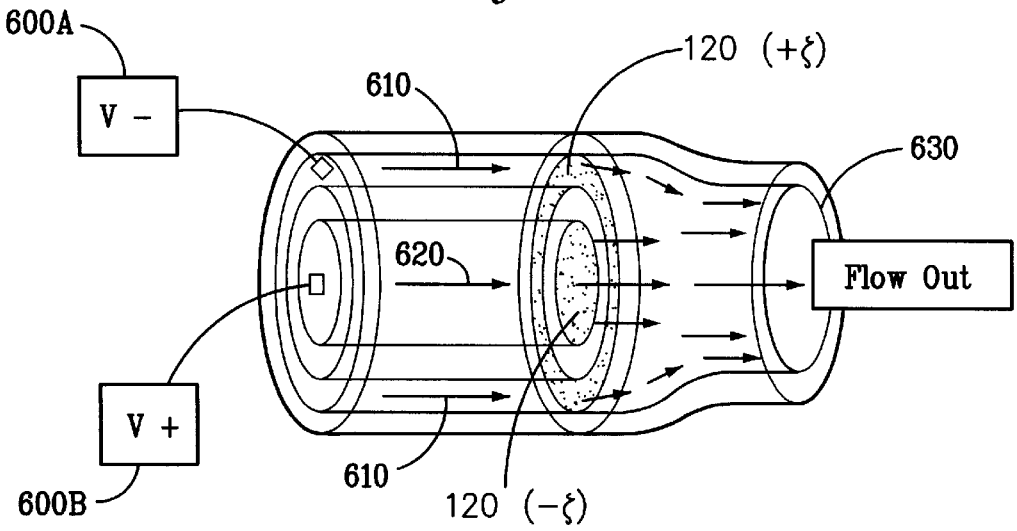
FIG. 7 illustrates an embodiment for producing two-dimensional layered flow.

The inventors have contemplated a geometry that employs the electrokinetic pumps of the present invention and that provides true or two-dimensional sheath flow. FIG. 7 shows how an arrangement of two concentric cylindrical pumps 600A and 600B can be used to create a true sheath flow in three dimensions. The outer pump (600A) can have a porous dielectric material with a zeta potential of opposite sign to that of the inner pump (600B). The fluid flow 610 from outer pump 600A would completely surround the fluid flow 620 from inner pump 600B, protecting the inner fluid column from contact with the walls of the outflow tube 630.

In three dimensions, it is also possible to have pumps split, and fluid channels pass over or under each other before exiting. Thus, a single pump could have a number of fluid outlets that are in some pattern intermingled with fluid outlets from another channel, so there are many alternative flow geometries to the simple concentric cylinders illustrated above. Further, for some purposes it can be desirable that a fluid flow channel, such as 225, act as a reservoir.

In summary, by careful control and selection of porous dielectric materials used in the construction of electrokinetic pumps, the present invention has been shown not only to provide a method and apparatus for eliminating current interruption by gas bubbles formed during the process of electrokinetic pumping that can cause pump failure but also provides for purely pressure-driven flow. Particularly important features of these porous materials are the magnitude and direction of the electroosmotic flows produced in the materials by a given applied voltage. These features, in turn, reflect properties such as the surface charge of the pores in the dielectric material and whether the pores are large enough to support electric osmotic flow. Various combinations of porous dielectric materials and ionic conductors can be used to create pumps that have desirable electrical, material handling, and flow attributes.

It will be understood that the described arrangements of apparatus and the methods pertaining thereto are merely illustrative of applications of the principles of this invention and many other embodiments and modifications can be made by those of skill in the art without departing from the spirit and scope of the invention as defined in the claims.

We claim:

1. An apparatus for providing a layered flow, comprising:

electrokinetic pumps connected together at their fluid outlets to form a common intersection and a flow channel to receive the layered flows from each fluid outlet, wherein the fluid outlet of each electrokinetic pump is shaped to form a layered flow, and wherein each electrokinetic pump comprises i) a capillary channel having a fluid inlet and outlet and a porous dielectric material disposed in said channel, wherein at least one of the porous dielectric materials has a positive surface charge or zeta potential and at least one of the porous dielectric materials has a negative surface charge or zeta potential, ii) an electrolyte contained within said channel and in communication with the porous dielectric material, and iii) at least two spaced electrodes, wherein, one of said electrodes is in communication with the fluid inlet of one electrokinetic pump and the other electrode is in communication with the fluid inlet of the second electrokinetic pump, and iv) means for applying an electric potential to said spaced electrodes.

2. The apparatus of claim 1, wherein at least one electrokinetic pump has more than one fluid outlet.

3. The apparatus of claim 1, wherein the fluid outlets are concentric.

4. The apparatus of claim 1, wherein the flow channel includes a reservoir.

5. The apparatus of claim 1, wherein said means for applying applies an electric potential that can vary in polarity and magnitude.

6. A method for forming a layered flow, comprising:

connecting at least two electrokinetic pumps together at their fluid outlets to form a common intersection and flow channel, wherein each fluid outlet is shaped to form a layered flow and wherein at least one electrokinetic pump has a porous dielectric material disposed therein that has a positive surface charge and the other electrokinetic pump has a porous dielectric material disposed therein with a negative surface charge.

* * * * *